US005878877A

United States Patent [19]

Sutherland

[11] Patent Number: 5,878,877

[45] Date of Patent: Mar. 9, 1999

[54] BASKET CARRIER WITH ROUNDED CORNERS

[76] Inventor: Robert L. Sutherland, 4929 Pembridge La., Kennesaw, Ga. 30152

[21] Appl. No.: 951,847

[22] Filed: Oct. 16, 1997

[51] Int. Cl.[6] ..... B65D 75/00

[52] U.S. Cl. ..... 206/167; 206/175

[58] Field of Search ..... 206/140, 147, 206/152, 162, 167, 170, 174, 175, 180, 186, 187, 193, 196, 198, 427, 429, 434, 176

[56] References Cited

U.S. PATENT DOCUMENTS 3,814,238 6/1974 Wood ..... 206/167
5,332,091 7/1994 Gugler ..... 206/167
5,472,090 12/1995 Sutherland ..... 206/427
5,542,536 8/1996 Sutherland ..... 206/427
5,593,027 1/1997 Sutherland ..... 206/170
5,657,864 8/1997 Harrelson ..... 206/152

*Primary Examiner*—Bryon P. Gehman

[57] ABSTRACT

A basket carrier for beverage bottles. The end cells of the carrier are narrower than the interior cells, so that when the carrier is loaded the end bottles force out the end panels, creating a tight fit and rounded corners. The carrier is formed from a single blank. Fold lines may be provided in the end and side panels to facilitate forming the rounded corners.

8 Claims, 3 Drawing Sheets

BASKET CARRIER WITH ROUNDED CORNERS

FIELD OF THE INVENTION

This invention relates to a basket-style carrier for packaging articles such as beverage bottles. More particularly, it relates to a basket-style carrier having rounded corners.

BACKGROUND OF THE INVENTION

Basket-style carriers are commonly employed to package beverage bottles. They normally include a central handle panel located between spaced parallel side panels, a bottom panel connected to the side panels and end panels connected to both the side panels and the handle panel. Dividers extending from the handle panel to the side panels are often included to provide individual cells for the bottles. The packaged bottles typically extend up beyond the side and end panels so that substantial upper portions of the bottles are visible. This is deemed beneficial since a distinctively shaped bottle known to be associated with the beverage company can thus be more readily identified.

Typically, basket-style carriers of this type are fabricated from collapsed carriers which have been formed from blanks. The carriers are loaded either by dropping bottles into place after the bottom panel has been formed or by moving an opened carrier over the bottles and then forming the bottom panel. Packaging machines designed to load and form the finished basket carrier package are employed to rapidly carry out these operations.

Basket carriers are conventionally made with the end panels at right angles to the side panels, giving a squared appearance. This arrangement also makes the gluing process simpler. Although such basket carriers are satisfactory from a performance point of view, it would be desirable from a marketing point of view to be able to package bottles in a basket-style carrier so that the end panels closely follow the contour of the end bottles. The resulting rounded corners not only would show off the shape of the bottles to greater advantage but would provide an additional degree of integrity to the carrier as a result of the corners more tightly holding the end bottles in place.

An object of the invention, therefore, is to provide a basket carrier having rounded corners which meet the desired goals noted above. Another object is to provide such a carrier which can be glued by means of a flat gluing process. The carrier must also possess adequate strength and rigidity, and preferably should be produced from a nested web arrangement to minimize the required amount of paperboard.

BRIEF SUMMARY OF THE INVENTION

The invention is incorporated in a basket-style carrier for packaging articles with cylindrical bodies, such as beverage bottles. The carrier includes a bottom panel, a pair of opposite side panels foldably connected to the bottom panel, a pair of opposite end panels foldably connected to the side panels and a central panel foldably connected to the end panels. The central panel divides the carrier into article-receiving areas between the side panels and the central panel, and a plurality of divider partitions extending from the central panel to the side panels further divides the article receiving areas into cells, including end cells. The end cells have a width less than the diameter of the cylindrical bodies of the articles, which causes the end panels to flex outwardly when an article is loaded into the end cells. The end panels thus substantially conform to the curved body of the end articles, tightly holding the articles in place and providing esthetically pleasing rounded corners.

In a preferred arrangement the divider partitions create interior cells, the width of which is greater than the diameter of the article bodies. When the divider partitions are pushed toward the interior cells by the entry of the bottles into the end cells, portions of the partitions are moved toward the interior cells to a position engaging the article bodies in the interior cells. Vertical fold lines may be provided in the end and side panels to facilitate outward flexing of the end panels.

The invention is preferably incorporated in a carrier of the type in which the end panels are comprised of two end panel sections which are foldably connected to an associated side panel and to the central panel.

The carrier is readily formed from a single blank and can be packaged on the same machine used to package conventional basket carriers. The carrier is strong and rigid and presents a highly pleasing appearance as well.

These and other features and aspects of the invention will be readily ascertained from the detailed description of the preferred embodiment described below.

DETAILED DESCRIPTION OF THE PREFERRED EMBODIMENT

Figure 1:
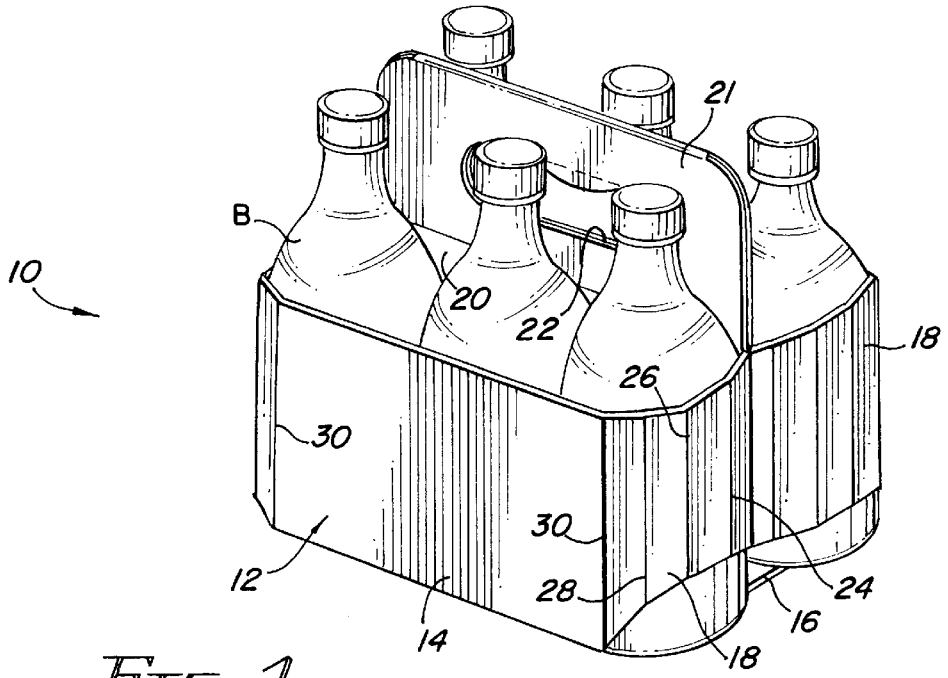
FIG. 1 is a pictorial view of a basket-style carrier incorporating the invention.
Figure 2:
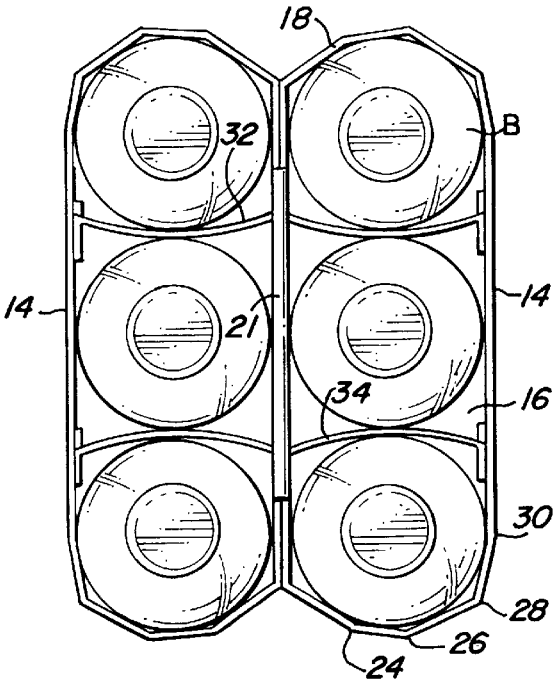
FIG. 2 is a plan view of the blank of FIG. 1.

Referring to FIGS. 1 and 2, the package 10 is comprised of basket-style carrier 12 containing two rows of three beverage bottles B. Opposite side panels 14 are foldably connected to bottom panel 16 and to curved end panel sections 18. Each end panel section is foldably connected to a central support panel 20, the upper portion of which functions as a handle panel 21. Handle opening 22 in the handle panel provides a grip for lifting and carrying the package. The end panel sections, which include vertical fold lines 24 and 26, are connected to the side panels 14 by fold lines 28. The fold lines 24, 26 and 28, along with fold line 30 in the side panels, facilitate the rounding of the end panel sections. As shown in FIG. 2, transverse divider partitions 32 and 34 extend between the central support panel and the side panels to create individual cells for the bottles. The curved end panels substantially conform to the curvature of the end bottles and contact the bottles to tightly hold the end bottles in place while creating rounded carrier corners.

Figure 3:
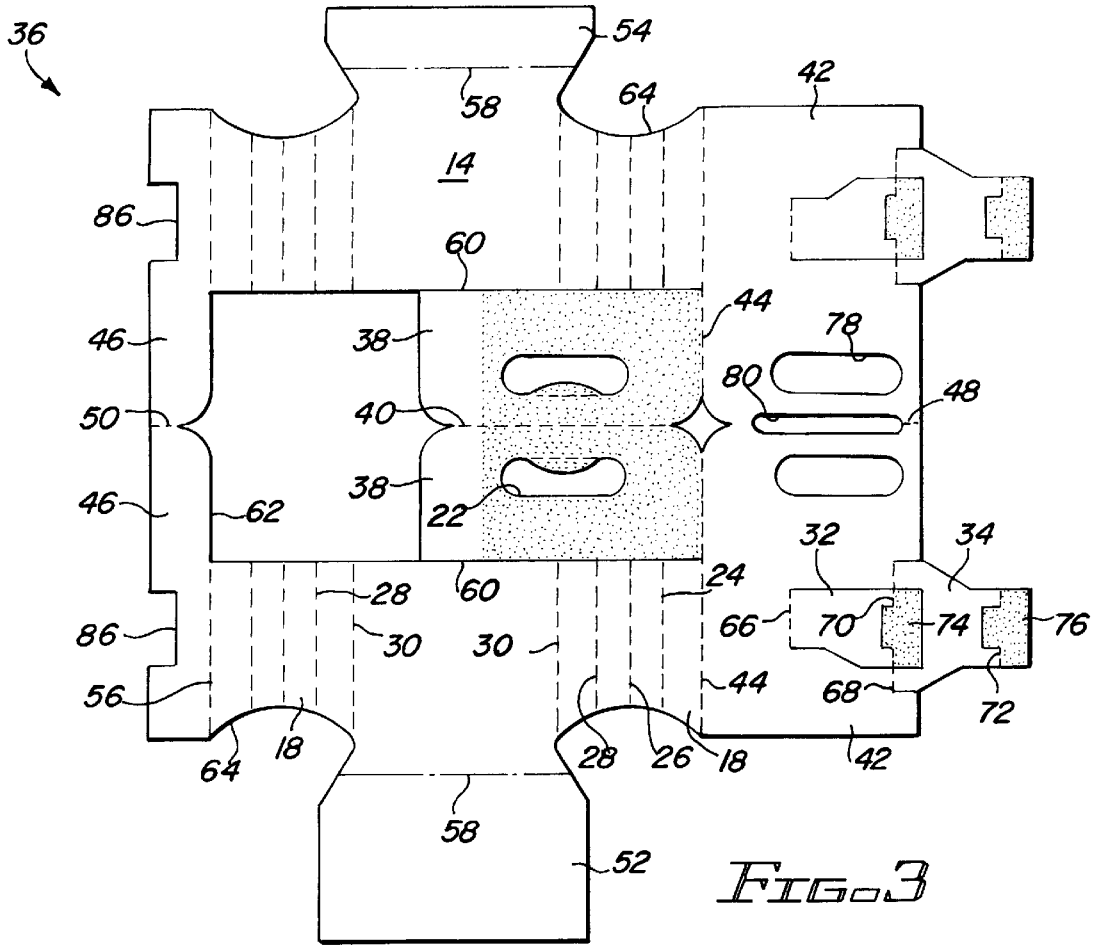
FIG. 3 is a plan view of a blank for fabricating the carrier.

Referring to FIG. 3, a blank 36 for forming the carrier is comprised of paperboard or other suitably strong, flexible material. In the central portion of the lank two handle panel sections 38, each containing a handle opening 22, are connected to each other by fold line 40 and are further connected at one end to a pair of central support panel sections 42 by fold lines 44. The opposite ends of the handle panel sections are spaced from a pair of riser panel sections 46. The support panel sections are connected to each other by fold line 48 and the riser panel sections are connected to each other by fold line 50. The fold lines 40, 48 and 50 are aligned with each other and, except for the different lengths of bottom panel flaps 52 and 54, basically divide the blank into two similar halves.

Connected to the riser panel sections 46 by fold lines 56 are two of the end panel sections 18. The other two end panel sections 18 are connected to support panel sections 42 by extensions of the fold lines 44. Side panel sections 14 are connected to the end panel sections by the fold lines 28 and to bottom panel flaps 52 and 54 by fold lines 58. The handle panel sections 38 are separated from both the adjacent end panel sections 18 and the side panel sections 14 by slits 60 and by the opposite edges of cutout 62, which extends between the riser panel sections and the handle panel sections. The outer edges of the end panel sections 18 are inwardly curved, as at 64.

Connected to the central support panel sections 42 by fold lines 66 and 68 are the divider flaps 32 and 34, respectively, and connected to the divider flaps 32 and 34 by fold lines 70 and 72 are glue flaps 74 and 76, respectively. The fold lines 68 are interrupted fold lines and are aligned with the fold lines 70. Contained in the central support panel sections 42 are handle openings 78. A further narrow cutout 80, interrupting the fold line 48, is provided for ease in folding the support panel sections during formation of a carrier.

To form a carrier from the blank, glue is applied to the handle panel sections 38 and to the partition glue flaps 74 and 76, as shown in stipple in FIG. 3. The support panel sections 42 are then pivoted inwardly about the fold lines 44. This adheres the support panel sections 42 to a major portion of the width of the handle panel sections 38 and the glue flaps 74 and 76 to the side panel sections 14. Also, the handle openings 78 in the support panel sections are aligned with the openings 22 in the handle panel sections. The blank at this interim stage of the carrier forming operation appears as illustrated in FIG. 4.

Figure 4:
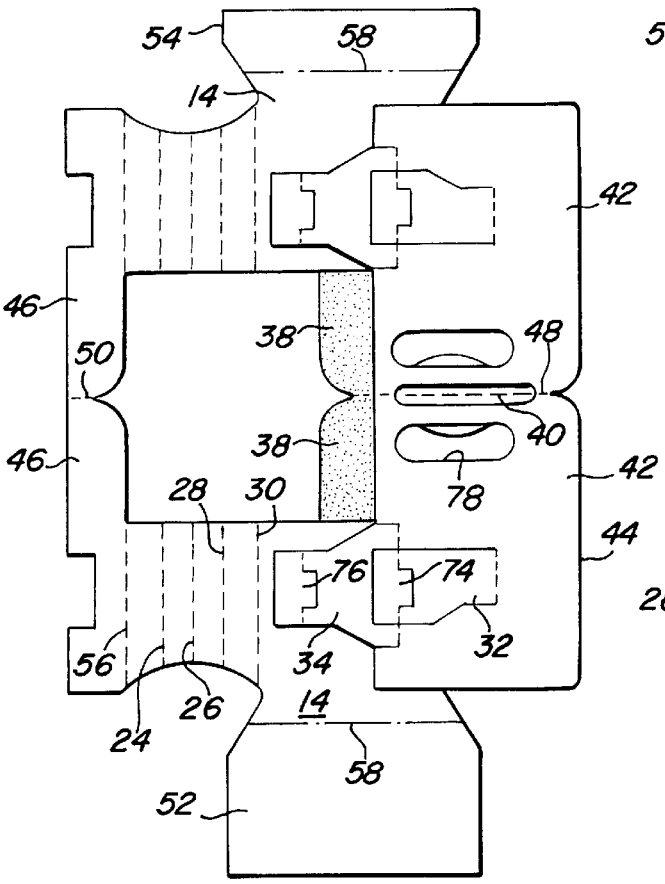
FIG. 4 is a plan view of the carrier blank after initial folding and gluing steps.

Glue is then applied to the exposed portions of the handle panel sections 38, as shown in stipple in FIG. 4, after which the end panel segments 18 at the left of the blank are folded about the fold lines 28. This adheres the riser panel sections 46 to the handle panel sections 38, so that both the support panel sections and the riser panel sections are adhered to the handle panel sections, as shown in FIG. 5.

Figure 5:
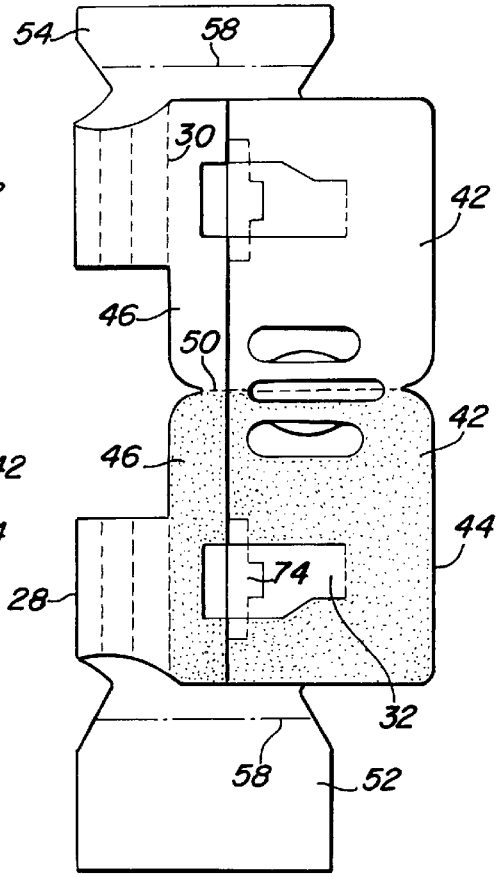
FIG. 5 is a plan view of the carrier blank after additional folding and gluing steps.
Figure 6:
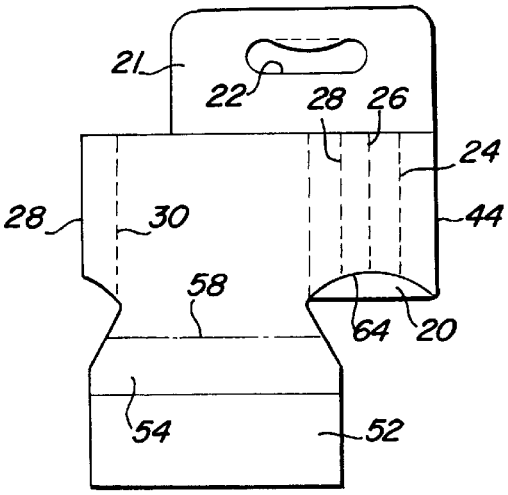
FIG. 6 is a plan view of a collapsed carrier resulting from a final folding and gluing step.

Glue is then applied to the stippled area of one of the riser panel sections and the associated support panel section, as shown in FIG. 5, and the blank is folded about the center fold lines 40, 48 and 50, resulting in the collapsed carrier shown in FIG. 6. This step adheres the riser panel sections to each other to form a two-ply riser panel and the support panel sections to each other to form a two-ply support panel. Since the handle panel sections are adhered to the riser panels and the support panels, the resulting handle panel 21 is of four-ply construction.

Figure 7:
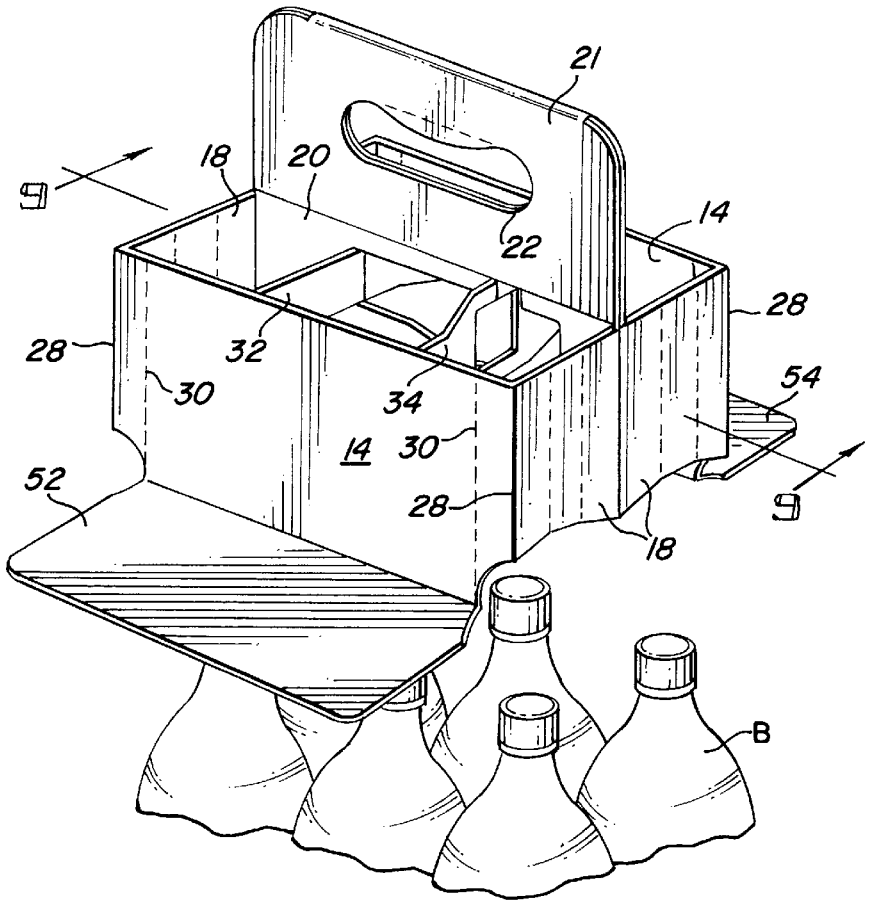
FIG. 7 is a pictorial view of an opened partially formed carrier in the process of being loaded with beverage bottles.

To form a package from the collapsed carrier of FIG. 6, inward pressure is applied to the end folds 28 and 44, which opens the collapsed carrier, causing the divider partitions to unfold and span the bottle receiving areas on each side of the center support panel. The open carrier, with the bottom panel flaps still open, is then moved down over the bottles to be packaged, as illustrated in FIG. 7. The bottles will have first been positioned in their final arrangement so that when the open carrier is moved down over them, the bottles are aligned with the cells created by the divider partitions. Although the bottom flaps are shown as having been folded up prior to the loading operation they could instead be in their original unfolded condition at this point, if desired.

Figure 8:
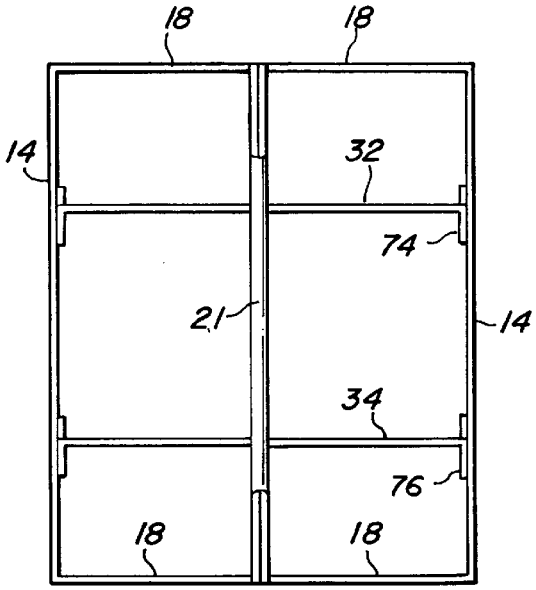
FIG. 8 is a plan view of the opened partially formed carrier of FIG. 7.
Figure 9:
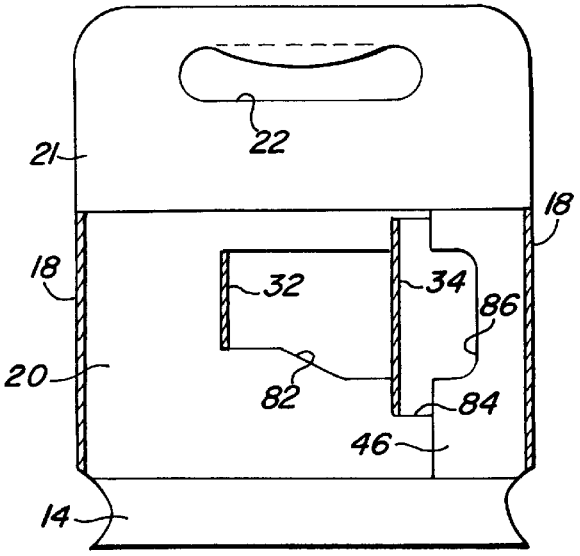
FIG. 9 is a longitudinal sectional view taken along line 9—9 of FIG. 7.

As can be seen from FIGS. 8 and 9, the opened carrier is in squared condition, typical of conventional basket carriers, with the end panels forming a right angle with the side panels. Note, however, that the bottle-receiving cells are not all the same size. The distance between the divider partitions 32 and 34 is somewhat greater than the distance between the partitions and the nearest end panel, making the center cells wider than the end cells. Each center cell is wider than the diameter of a packaged bottle and each end cell is narrower than the bottle diameter. When the bottles are moved into the cells the end bottles force the partitions 32 and 34 inwardly toward the adjacent interior cell, causing the end panels and the end portion of the side panels between the fold lines 30 and 28 to flex outwardly and curve about the bottles. The divider partitions flex in the opposite direction, with the distance between the innermost extent of the partitions being equal to the diameter of the bottles. Although the flexing of the end panels and the end portions of the side panels could take place without the fold lines 24, 26 and 30, it is preferred to include them since they facilitate the outward folding that occurs when the opened carrier is initially moved down over the bottles.

As seen in FIGS. 7 and 9, when the divider partitions 32 and 34 are folded out from the central support panel sections they leave openings 82 and 84 in the support panel. The opening 84 is made up of the openings created in the central support panel sections when the divider partitions 34 are folded out in combination with notches or cutouts 86 in the riser panel sections. These notches are shown in FIG. 3. Although the notches 86 play no role in the functioning of the finished carrier, they are of similar size and shape to the glue flaps 76, which allows the blanks to be laid out in the web from which they are formed in nesting relationship.

Note in FIGS. 5 and 9 that the riser panel sections and the support panel sections are not connected directly to each other but are merely abutted. This does not affect the ability of the carrier to support heavy loads since the main load on the carrier is parallel to the plane of the support panel, not transverse to it. The riser panel sections and the support panel sections are held in place as a unit by their adhesion to the handle panel sections 38.

While not involved in the structural aspects of the carrier, the spacing of the end panels from the bottom panel caused by the curved end panel section edges 64 allows the lower portions of the end bottles to be visible in the package, a feature which is desirable from a marketing point of view. Although preferred, this arrangement is not a required component of the invention.

Although the fold lines 28 in the finished package are located in the curved end portions of the carrier, they function as the corner fold lines in the opened carrier as it exists prior to the loading step. Thus, except for the difference in width of the end cells, the carrier blank and the opened collapsed carrier are similar in overall arrangement to conventional squared basket carriers. This allows the blanks to be glued and folded in the same manner as conventional squared basket carriers, thereby eliminating the need for different forming equipment to produce the collapsed carriers.

It can now be appreciated that the invention provides a basket-style carrier having rounded corners, which not only produces a very tight fit with the packaged articles but also results in a different esthetically pleasing appearance.

The thickness of the paperboard has been exaggerated in the drawings for the sake of clarity. It will be understood that in the actual carrier the thickness of the panels is quite small compared to the dimensions of the carrier.

It should be understood that the invention is not limited to all the specific details described in connection with the preferred embodiment, except as they may be within the scope of the appended claims, and that changes to certain features of the preferred embodiment which do not alter the overall basic function and concept of the invention are contemplated.

What is claimed is:

1. A basket-style carrier package comprising:

a plurality of articles with substantially uniform cylindrical bodies arranged in a side by side relationship in the package:

a bottom panel;

a pair of opposite end panels foldably connected to the bottom panel;

a pair of opposite end panels foldably connected to the side panels;

a central panel foldably connected to the end panels, the central panel dividing the carrier into article-receiving areas between the side panels and the central panel;

a plurality of divider partitions extending from the central panel to the side panels, the partitions dividing each article-receiving area into a plurality of cells, including two end cells; and each end cell having a width designed to be less than the diameter of the body of the article received within the end cell, whereby each end panel is flexed outwardly by the article received therein to substantially conform to the shape of the cylindrical body of the article inserted into the end cell said package further comprising an interior cell in each article-receiving area, the width of each interior cell being designed to be greater than the diameter of the cylindrical body of the article received within the interior cell, whereby each divider partition flexes inwardly to engage the cylindrical body of each article received within an interior cell.

2. A basket-style carrier package as defined in claim 1, wherein the end panels include vertical fold lines which facilitate outward flexing of the end panels.

3. A basket-style carrier package as defined in claim 2, wherein the side panels include vertical fold lines adjacent the end cells to facilitate outward flexing of the end panels.

4. A basket-style carrier package as defined in claim 1, wherein each end panel is comprised of two end panel sections, each end panel section having an end which is foldably connected to an associated side panel and an opposite end which is foldably connected to the central panel.

5. A basket-style carrier package as defined in claim 1, wherein the central panel is comprised of a main central panel portion and a riser panel portion, the main central panel portion being foldably connected to one end panel and the riser panel portion being foldably connected to the opposite end panel, the main central panel portion being substantially wider than the riser panel portion.

6. A basket-style carrier package as defined in claim 5 including a pair of foldably connected handle panel sections foldably connected to opposite faces of the main central panel portion, the handle panel sections being adhered to both portions of the central panel.

7. A basket-style carrier package as defined in claim 6, wherein the divider partitions are connected to the main portion of the central panel.

8. A basket-style carrier package as defined in claim 6, wherein each central panel portion is of two-ply construction.

* * * * *